US007906004B2

(12) United States Patent
Mizutani et al.

(10) Patent No.: US 7,906,004 B2
(45) Date of Patent: Mar. 15, 2011

(54) METHOD OF FORMING OXIDE FILM BY ANODICALLY OXIDIZING IN AN ELECTROLYTE SOLUTION

(75) Inventors: Fumikazu Mizutani, Fukuoka (JP); Toshiaki Sakakihara, Fukuoka (JP); Yasuhiro Kawase, Fukuoka (JP); Makoto Ishikawa, Fukuoka (JP)

(73) Assignee: Mitsubishi Chemical Corporation, Tokyo (JP)

( * ) Notice: Subject to any disclaimer, the term of this patent is extended or adjusted under 35 U.S.C. 154(b) by 283 days.

(21) Appl. No.: 11/577,144

(22) PCT Filed: Sep. 29, 2005

(86) PCT No.: PCT/JP2005/018022

§ 371 (c)(1),
(2), (4) Date: Apr. 12, 2007

(87) PCT Pub. No.: WO2006/040939

PCT Pub. Date: Apr. 20, 2006

(65) Prior Publication Data

US 2009/0023001 A1 Jan. 22, 2009

(30) Foreign Application Priority Data

Oct. 12, 2004 (JP) ..... 2004-297846
Mar. 23, 2005 (JP) ..... 2005-084209

(51) Int. Cl.
*C25D 11/06* (2006.01)
*C25D 11/26* (2006.01)

(52) U.S. Cl. ..... 205/234; 205/322; 205/332

(58) Field of Classification Search ..... 205/234, 205/322

See application file for complete search history.

(56) References Cited

U.S. PATENT DOCUMENTS

| | | | | |
|---|---|---|---|---|
| 6,368,485 | B1 * | 4/2002 | Ue et al. | 205/234 |
| 7,248,462 | B2 * | 7/2007 | Melody et al. | 361/528 |
| 7,286,336 | B2 * | 10/2007 | Liu et al. | 361/528 |
| 7,427,776 | B2 * | 9/2008 | Hoffman et al. | 257/59 |

FOREIGN PATENT DOCUMENTS

| | | | |
|---|---|---|---|
| JP | 6 208934 | | 7/1994 |
| JP | 6-216389 | | 8/1994 |
| JP | 9-138420 | | 5/1997 |
| JP | 11-246994 | | 9/1999 |
| JP | 2000 306913 | | 11/2000 |
| JP | 2000-328293 | | 11/2000 |
| JP | 2001 131794 | | 5/2001 |
| JP | 2001-131794 | * | 5/2001 |
| JP | 2001 135636 | | 5/2001 |

* cited by examiner

*Primary Examiner* — Alexa D Neckel
*Assistant Examiner* — William T Leader
(74) *Attorney, Agent, or Firm* — Oblon, Spivak, McClelland, Maier & Neustadt, L.L.P.

(57) ABSTRACT

A high-quality oxide film which is free from a pinhole and surface roughing caused by anodic oxidation and which has surface smoothness on a surface of a material to be treated containing a metal as a principal component. An electrolyte solution which is used for forming an oxide film on a surface of a material to be treated containing a metal as a principal component by anodic oxidation, the electrolyte solution containing a non-aqueous solvent containing an alcoholic hydroxyl group and having 4 or more carbon atoms as a main solvent. This non-aqueous solvent preferably contains two or more alcoholic hydroxyl groups and is especially preferably one or two or more members selected from the group consisting of diethylene glycol, triethylene glycol and polyethylene glycol. A method of forming an oxide film including a step of anodically oxidizing a material to be treated containing a metal as a principal component in this electrolyte solution.

4 Claims, No Drawings

METHOD OF FORMING OXIDE FILM BY ANODICALLY OXIDIZING IN AN ELECTROLYTE SOLUTION

TECHNICAL FIELD

The present invention relates to an electrolyte solution for forming an oxide film by anodic oxidation on a surface of a material to be treated containing a metal as a principal component (this electrolyte solution will be hereinafter sometimes referred to as "forming electrolyte") and a method of forming an oxide film on a surface of a material to be treated containing a metal as a principal component by anodic oxidation using this electrolyte solution (this treatment for forming an oxide film will be hereinafter sometimes referred to as "anodization") to a material to be treated having a metal oxide film formed by anodic oxidation using this electrolyte solution and to a metal oxide film formed on a surface of a material to be treated by anodic oxidation using this electrolyte solution. In particular, the invention relates to an electrolyte solution for efficiently forming a high-quality oxide film which is free from a pinhole and which has excellent surface smoothness on a surface of a material to be treated containing a metal as a principal component, to a method of forming an oxide film using the same, to a material to be treated and to a metal oxide film.

The invention can be suitably applied especially to a material to be treated containing, as a principal component, a valve metal such as aluminum tantalum, and niobium

BACKGROUND ART

The "valve metal" as referred to herein means a metal having a so-called valve action (rectification action) in which an oxide layer on the subject metal passes a current therethrough only in one direction but does not substantially pass a current therethrough in a reverse direction thereto (*Handook of Metal Finishing Technology* (*Revised New Edition*), page 712 (1976), edited by The Metal Finishing Society of Japan); and the oxide film formed on a surface of a material to be treated containing a valve metal as a principal component differs from oxide films formed on other noble metal or transition metal or the like in a number of points and is utilized in many applications while making the best use of its characteristic properties. For example, this oxide film is used as an oxide film in various electronic parts or devices, especially dielectric thin films used in capacitors or semiconductor devices, gate dielectric films of thin film transistor, reflectors of flat panel display, switching devices, or the like.

Such an oxide film used as a dielectric thin film of capacitor or semiconductor device, a gate dielectric film of thin film transistor, or the like is required to have such properties that it is thin, minute and free from a pinhole and that its surface is smooth (flat). Since an oxide film obtained by anodization of a material to be treated containing a valve metal as a principal component theoretically has such characteristic features that it does not form a pinhole at the time of film formation and that it is minute, it has hitherto been considered that such an oxide film is useful for these applications.

Various materials have hitherto been proposed as a forming electrolyte used in such anodization. For example, in JP-A-2000-328293, by using a forming electrolyte having an aromatic carboxylic acid salt dissolved in ethylene glycol and water as solvents, an oxide film having high dielectric properties and high hillock resistance is formed within a short period of time.

However, in recent years, following the microfabrication of various devices, there has hitherto been a demand to form an oxide film which is more minute and higher in the surface smoothness. Also, from the viewpoint of making it easy to treat a waste liquid while taking into consideration the environment, there has been a demand to reduce the amount of a non-aqueous solvent in the forming electrolyte and to increase the water content. Also, since ethylene glycol is subjective to "The Law concerning Reporting, etc. of Releases to the Environment of Specific Chemical Substances and Promoting Improvements in Their Management (Law for PRTR)", it is preferable that the use of ethylene glycol is avoided, if possible.

In addition, the case where water is contained in a forming electrolyte involves a problem that the film quality of an oxide film to be formed varies depending upon a fluctuation of the water content in the forming electrolyte. Thus, there is also a demand to reduce influences by this fluctuation of the water content.

There have also been made various proposals with respect to electrical conditions of anodic oxidation in the anodization.

If an oxidation current density in anodic oxidation is increased, there may be a case where the growth of an oxide film is too fast so that a largely roughed film against the film thickness is liable to be formed, whereby an oxide film having a smooth surface is not formed. Then, in order to solve this problem the anodic oxidation is in general carried out through a two-stage anodic oxidation process including a constant current anodic oxidation step and a constant voltage anodic oxidation step. That is, this process is a measure in which anodic oxidation is first carried out at a constant current until the voltage reaches a value corresponding to an expected film thickness, thereby forming an oxide film; and thereafter, in order to restore the roughing of the formed oxide film, the voltage is kept at a constant voltage as it stands until the current is thoroughly reduced.

However, even in such a two-stage anodic oxidation process, if the current density of the constant current anodic oxidation step is excessively increased or the time of the constant voltage anodic oxidation step is too short, there is involved a problem that surface roughing of the formed oxide film is caused.

J-A-6-216389 describes that anodic oxidation by an alternating current containing a direct current component is carried out, thereby enhancing the film quality of a formed oxide film. However, this method involved a problem that since an alternating current is used, a special and expensive power source is necessary. Also, JP-A-9-138420 describes that constant current anodic oxidation is carried out at a very high current density, thereby obtaining a flat film free from waving. However, in such anodic oxidation at a high current density, even if waving is overcome, fine roughing cannot be avoided, and therefore, it is difficult to apply this method to a reflector or a device for which fine and high-degree surface smoothness is required.

Patent Document 1: JP-A-2000-328293
Patent Document 2: JP-A-6-216389
Patent Document 3: JP-A-9-138420

DISCLOSURE OF THE INVENTION

Problems that the Invention is to Solve

In response to the foregoing requirements the invention is aimed to provide an electrolyte solution for forming a high-quality oxide film which is free from a pinhole and surface roughing caused by anodic oxidation and which has surface smoothness on a surface of a material to be treated containing a metal as a principal component and a method of forming an oxide film using the same.

In addition, the invention is aimed to provide such a high-quality metal oxide film and a stack having a metal oxide film on a surface of a material to be treated and a process of producing the same.

Also, the invention is aimed to provide an electrolyte solution which even when the water content is increased, is able to form a high-quality film and in which a change of the film quality due to a fluctuation of the water content is reduced and a method of forming an oxide film using the same. In addition, the invention is aimed to provide an electrolyte solution which is able to stably form such a high-quality oxide film irrespective of specified electrical conditions and a method of forming an oxide film using the same. In addition, the invention is aimed to provide an electrolyte solution using a non-aqueous solvent which does not infringe on the Law for PRTR and capable of reducing the amount of the non-aqueous solvent therein and a method of forming an oxide film using the same.

Means for Solving the Problems

The present inventors made extensive and intensive investigations. As a result, it has been found that the foregoing problems are solved by using a specified non-aqueous solvent as a main solvent of an electrolyte solution, leading to achievement of the invention.

Specifically, the gist of the invention resides in an electrolyte solution which is used for forming an oxide film on a surface of a material to be treated containing a metal as a principal component by anodic oxidation, the electrolyte solution containing 50% by mass or more of a non-aqueous solvent containing an alcoholic hydroxyl group and having 4 or more carbon atoms.

In the invention, the non-aqueous solvent preferably contains two or more alcoholic hydroxyl groups and is more preferably one or two or more members selected from the group consisting of diethylene glycol, triethylene glycol and polyethylene glycol.

Also, the electrolyte solution of the invention preferably further contains water. In that case, it is preferable that the water is contained in an amount of 1% by mass or more and less than 80% by mass based on the foregoing non-aqueous solvent.

In addition, the electrolyte solution of the invention contains an anion derived from an aromatic carboxylic acid or a hydroxycarboxylic acid.

Also, another gist of the invention resides in an electrolyte solution not only containing 50% by mass or more of a non-aqueous solvent containing an alcoholic hydroxyl group and having 4 or more carbon atoms but also containing 1% by mass or more and less than 80% by mass of water based on the foregoing non-aqueous solvent.

In the invention, the non-aqueous solvent preferably contains two or more alcoholic hydroxyl groups and is more preferably one or two or more members selected from the group consisting of diethylene glycol, triethylene glycol and polyethylene glycol.

Also, the electrolyte solution of the invention contains an anion derived from an aromatic carboxylic acid or a hydroxycarboxylic acid.

Also, another gist of the invention resides in a method of forming an oxide film including a step of anodically oxidizing a material to be treated containing a metal as a principal component in this electrolyte solution.

Preferably, this material to be treated contains a valve metal as a principal component.

Also, another gist of the invention resides in a stack having a metal oxide film on a surface of a material to be treated containing a metal as a principal component, which is characterized in that the foregoing metal oxide film is a film formed on the surface of the foregoing material to be treated by anodic oxidation by using an electrolyte solution containing, as a main solvent, a non-aqueous solvent containing an alcoholic hydroxyl group and having 4 or more carbon atoms.

Also, another gist of the invention resides in a process of producing a stack having a metal oxide film on a surface of a material to be treated containing a metal as a principal component, which is characterized by including a step of anodically oxidizing the surface of the foregoing material to be treated by using an electrolyte solution containing, as a main solvent, a non-aqueous solvent containing an alcoholic hydroxyl group and having 4 or more carbon atoms to thereby form the metal oxide film.

Also, another gist of the invention resides in a metal oxide film, which is characterized by a film formed on a surface to be treated containing a metal as a principal component by anodic oxidation by using an electrolyte solution containing as a main solvent, a non-aqueous solvent containing an alcoholic hydroxyl group and having 4 or more carbon atoms.

Advantages of the Invention

According to the electrolyte solution of the invention and the method of forming an oxide film using the same, there is brought an advantage that a high-quality oxide film which is free from a pinhole and surface roughing and which has high surface smoothness can be obtained; and the invention can be suitably employed for the formation of almost all oxide films which are required to be minute and smooth, such as thin film transistors, ceramic capacitors, MIM type diodes, and MIM type field emission devices.

Also, according to the electrolyte solution of the invention and the method of forming an oxide film using the same, since a high-quality oxide film can be obtained without employing the conventional control of electrical conditions, there is brought an advantage that the costs can be reduced without necessity to use an expensive special device.

Also, according to the electrolyte solution of the invention and the method of forming an oxide film using the same, since even by increasing the water content in the electrolyte solution, a high-quality film is formed, the amount of the non-aqueous solvent in the electrolyte solution can be reduced, thereby increasing the water content. Moreover, the material to be treated which does not infringe on the Law for PRTR can be used, the treatment of a waste liquid becomes easy, and the electrolyte solution of the invention is friendly against the environment. In addition, since a change of the film quality due to a fluctuation of the water content can be reduced, the control of the liquid component becomes easy, and the convenience increases. The electrolyte solution of the invention is suitable for the use under an environment where the water content is liable to fluctuate.

In addition, according to the invention, there is brought an advantage that a stack having a high-quality oxide film which is free from a pinhole and surface roughing and which has surface smoothness formed on a surface of a material to be treated is obtainable. While such a stack made of a material to be treated on which a high-quality metal oxide film is formed can be used for various applications, for example, it can be suitably used for thin film transistors, ceramic capacitors, MIM type diodes, MIM type field emission devices, or reflectors of a flat panel display.

Also, according to the invention, there is brought an advantage that a high-quality oxide film which is free from a pinhole and surface roughing and which has surface smoothness is obtainable. While such a high-quality metal oxide film can be used for various applications, for example, it can be suitably used for thin film transistors, ceramic capacitors, MIM type diodes, MIM type field emission devices, or reflectors of a flat panel display.

BEST MODES FOR CARRYING OUT THE INVENTION

Preferred embodiments of the electrolyte solution of the invention and the method of forming an oxide film using the same, the stack and the process of producing the same, and the metal oxide film are hereunder described in detail.

In the invention, an electrolyte solution containing, as a main solvent, a non-aqueous solvent containing an alcoholic hydroxyl group and having 4 or more carbon atoms is used as an electrolyte solution to be used for forming an oxide film on a surface of a material to be treated containing a metal as a principal component, and preferably a material to be treated containing a valve metal as a principal component by anodic oxidation.

Incidentally, with respect to the "main solvent" as referred to in the invention, in the case where one kind of a solvent is used singly, the subject solvent is meant; and in the case where two or more kinds of solvents are combined and used, a solvent having the highest ratio by mass is meant.

[Material to be Treated Containing a Metal as a Principal Component]

In the invention, the "metal" as referred to herein also includes an alloy. Furthermore, the "material to be treated containing a metal as a principal component" as referred to herein means that an element contained in the largest amount in the material to be treated is a metal. Preferably, the metal is contained in an amount of 50% by mass or more and not more than 100% by mass.

Preferably, the material to be treated contains a valve metal as a principle component.

As described previously, the "valve metal" as referred to in the invention means a metal in which an oxide layer on the subject metal passes a current therethrough only in one direction but does not substantially pass a current therethrough in a reverse direction thereto. While the valve metal used in the invention is not particularly limited so far as it is able to form a minute and smooth oxide film, examples thereof include one or two or more members selected from the group consisting of aluminum, tantalum, titanium, niobium, zirconium hafnium tungsten, molybdenum, vanadium, and silicon. One or two or more members selected from the group consisting of aluminum, tantalum titanium niobium, zirconium, and hafnium are preferable; one or two or more members selected from the group consisting of aluminum tantalum and niobium are more preferable; and aluminum and/or tantalum is further preferable.

Of these, since an anodically oxidized film of aluminum not only has various specificities in its geometric structure and physical/chemical/optical properties but also can be precisely controlled with respect to the specificities by varying conditions of anodic oxidation, it can be utilized for a variety of applications while making the best use of functionality of the anodically oxidized film and is especially preferable.

Incidentally, the "material to be treated containing a valve metal as a principal component" as referred to herein means that an element contained in the largest amount in the material to be treated is a valve metal. Preferably the total amount of the valve metal (in the case where plural valve metals are contained the total sum of these valve metals is meant) in the material to be treated is 50% by mass or more and not more than 100% by mass. In the case where properties as the valve metal are emphasized, the valve metal is contained in the material to be treated in a total amount of 85% by mass or more and not more than 100% by mass.

Incidentally the material to be treated which is subjective to the treatment in the invention may contain other material than the metal so far as the anodic oxidation relative to the invention is not hindered. Examples of other material than the metal include silicon, carbon, boron, and phosphorus, but it should not be construed that the invention is limited thereto.

[Electrolyte Solution]

(Solute)

While a solute anion contained in an electrolyte solution which is used for the anodic oxidation of the invention is not particularly limited, it is preferably an anion derived from an aromatic carboxylic acid or a hydroxycarboxylic acid.

As the aromatic carboxylic acid, compounds containing a carboxyl group as well as a benzene ring a fused benzene ring, a non-benzene based aromatic ring, a heteroaromatic ring, or the like can be used. Examples of hetero atom-free aromatic carboxylic acids which can be used in the invention include salicylic acid phthalic acid, benzoic acid, γ-resorcylic acid toluic acid, cumylic acid, t-butylbenzoic acid, anisic acid, 2,4-cresotinic acid, cinnamic acid, N-methylanthranthranilic acid, gentisic acid, gallic acid and p-hydroxybenzoic acid. Furthermore, examples of heteroaromatic carboxylic acids which can be used include nicotinic acid 2-furoic acid, 2-thenoic acid, and hydrazylbenzoic acid. In addition, an aromatic carboxylic acid containing a functional group other than the carboxyl group can be used so far as the expected effects of the invention are not hindered. For example, aromatic carboxylic acids containing a nitro group or an amino group such as nitrobenzoic acid, anthranilic acid, mono-methylaminobenzoic acid, and dimethylaminobenzoic acid can be used. These aromatic carboxylic acids may be used singly or in combination of two or more kinds thereof. Of these aromatic carboxylic acids, salicylic acid, phthalic acid benzoic acid and γ-resorcylic acid are preferable, with salicylic acid being especially preferable.

With respect to the hydroxycarboxylic acid though an optical isomer may be present, its type is not particularly limited and may be any of an L type, a D type or a DL type. The optical isomer may also be a meso body. Furthermore, both natural products and synthetic products are useful. Specific examples of the hydroxycarboxylic acid include α-hydroxy acids such as glycolic acid, lactic acid, α-hydroxy-n-butyric acid, α-hydroxyisobutyric acid, α-hydroxy-n-valeric acid, α-hydroxyisovaleric acid, 2-hydroxy-2-methylbutyric acid, and α-hydroxyacrylic acid; β-hydroxy acids such as hydroacrylic acid, β-hydroxybutyric acid, β-hydroxyisobutyric acid, β-hydroxy-n-valeric acid, β-hydroxyisovaleric acid, α-ethylhydroacrylic acid, and hydroxypivalic acid; and hydroxydicarboxylic acids such as monohydroxycarboxylic acids, for example, tartronic acid, methyltartronic acid, ethyltartronic acid, hydroxymethylmalonic acid, malic acid, citramalic acid, and α-hydroxy-α'-methylsuccinic acid and dihydroxycarboxylic acids, for example, tartaric acid. In addition, a hydroxycarboxylic acid containing a functional group other than an alcoholic hydroxyl group or a carboxyl group and having from 2 to 5 carbon atoms can also be used so far as the expected effects of the invention are not hindered. These hydroxycarboxylic acids may be used singly or in combination of two or more kinds thereof. Of these hydroxycarboxylic acids, lactic acid, malic acid, and tartaric acid are preferable.

Incidentally, the solute may contain one or more aromatic carboxylic acids and one or more hydroxycarboxylic acids.

Preferably, the solute contains one or more aromatic carboxylic acids.

While a counter ion against the solute anion is not particularly limited for example, an ammonium ion an alkali metal ion, a primary, secondary, tertiary or quaternary alkylammonium ion, a phosphonium ion, and a sulfonium ion can be used. Above all, it is preferred to use an ammonium ion or a primary, secondary, tertiary or quaternary alkylammonium ion. In the case where the alkylammonium ion is used, while the carbon atom number of the alkyl group can be chosen while taking into consideration the solubility in a solvent, an alkyl group having from 1 to 4 carbon atoms is usually chosen.

These solutes may be used singly or in combination of two or more kinds thereof. Furthermore, the foregoing solute may be combined with an arbitrary solute other than the foregoing and used.

In particular, the solute of the electrolyte solution of the invention is preferably an ammonium salt of an aromatic carboxylic acid and/or an ammonium salt of tartaric acid; more preferably an ammonium salt of an aromatic carboxylic acid; and most preferably ammonium salicylate.

While a concentration of such a solute in the electrolyte solution of the invention is not particularly limited so far as the solute is stably dissolved the concentration of the solute is usually 0.01% by mass or more, preferably 0.1% by mass or more, and especially preferably 1% by mass or more; and usually not more than 30% by mass, preferably not more than 25% by mass, and especially preferably not more than 15% by mass. For the purpose of increasing the conductivity of the electrolyte solution and making it easy to achieve oxidation at a usual current density, it is desirable that the concentration of the solute is not excessively low. Furthermore, for the purpose of suppressing the dissolution of the formed oxide film, it is desirable that the solute concentration is not excessively high.

(Main Solvent)

The electrolyte solution of the invention contains, as a main solvent, a non-aqueous solvent containing an alcoholic hydroxyl group and having 4 or more carbon atoms. The main solvent is preferably a non-aqueous solvent containing two or more alcoholic hydroxyl groups and having 4 or more carbon atoms.

When the carbon atom number of this non-aqueous solvent is too small, the amount of the non-aqueous solvent to be taken into the oxide film increases resulting in a cause of surface roughing. Accordingly, in the invention, the carbon atom number of the non-aqueous solvent is defined to be 4 or more. However, for the purpose of increasing the conductivity of the electrolyte solution and making it to easy to achieve oxidation at a usual current density, it is desirable that the carbon atom number of the non-aqueous solvent is not excessively large. The carbon atom number of the non-aqueous solvent is preferably not more than 15, and more preferably not more than 10.

For the same reasons, it is preferable that a molecular weight of the non-aqueous solvent according to the invention is 80 or more, and especially 100 or more; and not more than 400, and especially not more than 200.

As such a non-aqueous solvent, one or two or more members of glycols such as diethylene glycol, triethylene glycol, and polyethylene glycol; chain alcohols such as butanol and hexanol; and alicyclic alcohols such as cyclohexanol can be enumerated. One or two or more members selected from the group consisting of diethylene glycol, triethylene glycol, and polyethylene glycol are preferable. Diethylene glycol, triethylene glycol, and polyethylene glycol are also suitably used from the viewpoint that they do not infringe on the Law for PRTR. Incidentally, as the polyethylene glycol, one having an average molecular weight of 100 to 400, and especially from 100 to 200 is preferable for the foregoing reasons.

When the anodically oxidized film is partially formed on the material to be treated, a measure such as photolithography using a photoresist is employed. In order to suppress the dissolution of this photoresist, it is desirable that the number of the alcoholic hydroxyl group of this non-aqueous solvent is not excessively small. Accordingly, it is preferable that the number of the alcoholic hydroxyl group of this non-aqueous solvent is 2 or more. However, for the purposes of increasing the electric conductivity of the electrolyte solution and making it easy to achieve oxidation at a usual current density, it is desirable that the number of the alcoholic hydroxyl group of the non-aqueous solvent is not excessively large. The number of the alcoholic hydroxyl group of the non-aqueous solvent is preferably not more than 3.

Most preferably, the number of the alcoholic hydroxyl group of the non-aqueous solvent is 2.

In particular, a ratio of the number of alcoholic hydroxyl group and the carbon atom number of the non-aqueous solvent which is used in the invention is preferably in the range of from ½ to ⅓ in terms of [(number of alcoholic hydroxyl group)/(carbon atom number)].

Incidentally, with respect to the "main solvent" as referred to herein, in the case where one kind of a solvent is used singly, the subject solvent is meant; and in the case where two or more kinds of solvents are combined and used, a solvent having the highest ratio by mass is meant.

In the electrolyte solution of the invention, it is preferable that the foregoing non-aqueous solvent as a main solvent is contained in an amount of 50% by mass or more, and especially 80% by mass or more; and not more than 99% by mass, and especially 95% by mass in the whole solvent of the electrolyte solution. In order to form a high-quality oxide film, it is desirable that the amount of the foregoing non-aqueous solvent in the electrolyte solution is large. However, for the purposes of increasing the electric conductivity of the electrolyte solution and making it easy to achieve oxidation at a usual current density, it is desirable that the amount of the foregoing non-aqueous solvent in the electrolyte solution is not excessively large.

(Co-Solvent)

It is preferable that the electrolyte solution of the invention contains water as a solvent other than the foregoing non-aqueous solvent (such a solvent will be hereinafter referred to as "co-solvent"). The content of water against the foregoing non-aqueous solvent (that is, the non-aqueous solvent containing an alcoholic hydroxyl group and having 4 or more carbon atoms) is preferably 1% by mass or more, more preferably 5% by mass or more, and further preferably 8% by mass or more; and preferably less than 80% by mass, more preferably less than 60% by mass, and further preferably less than 50% by mass. In order to obtain high electric conductivity, it is desirable that the electrolyte solution contains water to some extent. Furthermore, in particular, in order to obtain a high-quality oxide film, it is desirable that the amount of water in the electrolyte solution is not excessively large.

In the electrolyte solution of the invention, a co-solvent other than water can also be mixed and used. The co-solvent other than water may be used singly or in combination of two or more kinds thereof. It is preferable that one or two or more kinds of solvents selected from the group consisting of alcoholic hydroxyl group-containing solvents and aprotic organic solvents are contained as this co-solvent The alcoholic hydroxyl group-containing solvent which can be used as the co-solvent is irrespective of its kind, and both aliphatic alcohols and aromatic alcohols are useful. Of these, aliphatic alcohols are preferable. Examples thereof include monohydric alcohols such as methanol, ethanol, propanol, and isopropanol; dihydric alcohols such as ethylene glycol and propylene glycol; and trihydric or polyhydric alcohols. A solvent containing a functional group other than the alcoholic hydroxyl group in a molecule thereof can also be used so far as the expected effects of the invention are not hindered. For example, an alkoxy group-containing solvent such as methyl Cellosolve and Cellosolve can be used.

As the aprotic solvent, a polar solvent may be used, or a non-polar solvent may be used. As the polar solvent, lactone based solvents such as γ-butyrolactone, γ-valerolactone, and δ-valerolactone; carbonate based solvents such as ethylene carbonate, propylene carbonate, and butylene carbonate; amide based solvents such as N-methylformamide, N-ethylformamide, N,N-dimethylformamide, N,N-diethylformamide, N-methylacetamide, N,N-dimethylacetamide, and N-methylpyrrolidine; nitrile based solvents such as 3-methoxypropionitrile and glutaronitrile; and phosphoric ester based solvents such as trimethyl phosphate and triethyl phosphate can be enumerated. Furthermore as the non-polar solvent, hexane, toluene, silicone oil, and so on can be enumerated.

[Anodic Oxidation]

In the invention, while a measure of the anodic oxidation is not particularly limited it is preferable that a constant current anodic oxidation step is first carried out at a constant current density, followed by carrying out a constant voltage anodic oxidation step at a constant voltage. In that case, though the constant current anodic oxidation step is usually carried out with a direct current, an alternating component or a waving component may be added, and the current density may be gradually decreased or gradually increased step-by-step. Alternatively, as proposed in Japanese Patent Application No. 2004-113292, a method in which after carrying out anodic oxidation at a low current density, anodic oxidation is subsequently carried out at a high current density may be employed. By employing this method together, there is a possibility that an oxide film which is less in surface roughing and more smooth is obtained.

While the current density in the constant current anodic oxidation step is not particularly limited it is preferably 5 $\mu A/cm^2$ or more, more preferably 50 $\mu A/cm^2$ or more, further preferably 0.1 $mA/cm^2$ or more, and especially preferably 0.5 $mA/cm^2$ or more; and preferably less than 100 $mA/cm^2$, more preferably less than 50 $mA/cm^2$, further preferably less than 10 $mA/cm^2$, and especially preferably less than 5 $mA/cm^2$.

With respect to the treatment after carrying out this constant current anodic oxidation, though there are no particular restrictions, constant voltage anodic oxidation in which after reaching a previously defined formation voltage (Vf) by anodic oxidation at a constant current density, anodic oxidation is carried out while keeping that voltage for a fixed period of time is usually carried out. On that occasion, the ultimate voltage Vf is not particularly limited so far as it falls within the range wherein a sufficient oxide film is formed. It is usually not more than 500 V, preferably not more than 200 V, more preferably not more than 150 V, and especially preferably not more than 100 V; and preferably 1 V or more, more preferably 2 V or more, and especially preferably 3 V or more.

The temperature at the time of such anodic oxidation is a temperature range wherein the electrolyte solution is stably present as a liquid. It is usually −20° C. or higher and preferably 0° C. or higher; and usually not higher than 150° C., and preferably not higher than 100° C.

In the invention, the anodic oxidation may be carried out over the entire surface or in only a part of the material to be treated. When an oxide film is formed in only a part of the material to be treated it is also possible to select a portion to be anodically oxidized in advance by photolithography using a photoresist or other method.

The thus obtained oxide film is free from a pinhole and excellent in surface smoothness. For example, in comparison with the case of using a conventional electrolyte solution, it is also possible to reduce a value of mean surface roughness (Ra) or root mean surface roughness (RMS) to 50 to 80%.

A method of obtaining a metal oxide film from the material to be treated on which the metal oxide film has been thus formed is not particularly limited but may be carried out in the usual way. Examples thereof include a method of dissolving and removing the material to be treated by an acid or alkaline solution such as sulfuric acid and sodium hydroxide, or the like. For example, by stacking other metal substrate such as platinum on the metal oxide film which has been formed on an aluminum substrate as the material to be treated, removing the aluminum substrate as the material to be treated and then additionally stacking other metal substrate such as platinum thereon, a stack such as platinum/aluminum anodically oxidized film/platinum, which has not hitherto been seen (because it is impossible to form an oxide film on platinum by anodic oxidation) can be formed, too.

The invention is more specifically described below with reference to Examples and Comparative Examples, but materials, use amounts, proportions, treatment contents, treatment procedures and so on as shown in the following Examples can be properly changed so far as they do not deviate from the gist of the invention. Accordingly, the scope of the invention should never be restrictively construed by the following specific example.

EXAMPLES AND COMPARATIVE EXAMPLES WHERE THE MATERIAL TO BE TREATED IS Al

Example 1

A pure Al thin film having a thickness of about 300 nm was deposited on an alkali-free glass substrate by an ion plating method. Next, this film was subjected to constant current anodic oxidation in a 1% by mass ammonium salicylate solution in diethylene glycol having a water content of 10% by mass at a current density of 1 $mA/cm^2$ until the voltage reached 50 V, followed by constant voltage anodic oxidation at 50 V for 10 minutes, thereby forming an oxide film.

A surface roughness of the obtained oxide film was measured by using a software attached to an SPM (NANOPIX 1000, manufactured by Seiko Instruments Inc.) device. As a result, its mean surface roughness (Ra: one obtained by three-dimensionally expanding a center line mean surface roughness as defined in JIS B0601) was 0.17 nm, and its root mean surface roughness (RMS) was 0.22 nm.

Example 2

An oxide film was formed in the same manner as in Example 1, except that in Example 1, a 1% by mass ammonium salicylate solution in diethylene glycol having a water content of 30% by mass was used as the electrolyte solution.

Ra and RMS of the obtained oxide film were 0.20 nm and 0.26 nm, respectively.

Comparative Example 1

An oxide film was formed in the same manner as in Example 1, except that in Example 1, a 1% by mass ammonium salicylate solution in ethylene glycol having a water content of 10% by mass was used.

Ra and RMS of the obtained oxide film were 0.24 nm and 0.30 nm, respectively

Comparative Example 2

An oxide film was formed in the same manner as in Example 1, except that in Example 1, a 1% by mass ammonium salicylate solution in ethylene glycol having a water content of 30% by mass was used.

Ra and RMS of the obtained oxide film were 0.33 nm and 0.46 nm, respectively.

Example and Comparative Example Where The Material to be Treated Is Ta

Example 3

A pure Ta thin film having a thickness of about 200 nm was deposited on an alkali-free glass substrate by a sputtering method. Next, this film was subjected to constant current anodic oxidation in a 1% by mass ammonium salicylate solution in diethylene glycol having a water content of 30% by mass at a current density of 0.5 mA/cm$^2$ until the voltage reached 5 V, followed by constant voltage anodic oxidation at 5 V for 10 minutes, thereby forming an oxide film.

A surface roughness of the obtained oxide film was measured by using a software attached to an SPM (SPA-300HV, manufactured by Seiko Instruments Inc) device. As a result, its mean surface roughness (Ra: one obtained by three-dimensionally expanding a center line mean surface roughness as defined in JIS B0601) was 0.20 nm.

Comparative Example 3

An oxide film was formed in the same manner as in Example 3, except that in Example 3, a 1% by mass ammonium salicylate solution in ethylene glycol having a water content of 30% by mass was used.

Ra of the obtained oxide film was 0.27 nm.

Example and Comparative Example Where The Material To Be Treated Is Nb

Example 4

A pure Nb thin film having a thickness of about 400 nm was deposited on an alkali-free glass substrate by a sputtering method. Next, this film was subjected to constant current anodic oxidation in a 1% by mass ammonium salicylate solution in diethylene glycol having a water content of 30% by mass at a current density of 0.5 mA/cm$^2$ until the voltage reached 5 V, followed by constant voltage anodic oxidation at 5 V for 10 minutes, thereby forming an oxide film.

A surface roughness of the obtained oxide film was measured by using a software attached to an SPM (SPA-300HV, manufactured by Seiko Instruments Inc.) device. As a result, its mean surface roughness (Ra: one obtained by three-dimensionally expanding a center line mean surface roughness as defined in JIS B0601) was 0.93 nm.

Comparative Example 4

An oxide film was formed in the same manner as in Example 4, except that in Example 4 a 1% by mass ammonium salicylate solution in ethylene glycol having a water content of 30% by mass was used.

Ra of the obtained oxide film was 1.78 nm.

These results are summarized and shown in Table 1.

TABLE 1

| | | Composition of electrolyte solution | | | | Surface roughness of oxide film | |
|---|---|---|---|---|---|---|---|
| | | Solute | | | | | |
| Example | Material to be treated | Kind | Concentration (% by mass) | Kind of main solvent | Concentration of water (% by mass) | Ra (nm) | RMS (nm) |
| Example 1 | Al | Ammonium salicylate | 1 | Diethylene glycol | 10 | 0.17 | 0.22 |
| Example 2 | | Ammonium salicylate | 1 | Diethylene glycol | 30 | 0.20 | 0.26 |
| Comparative Example 1 | | Ammonium salicylate | 1 | Ethylene glycol | 10 | 0.24 | 0.30 |
| Comparative Example 2 | | Ammonium salicylate | 1 | Ethylene glycol | 30 | 0.33 | 0.46 |
| Example 3 | Ta | Ammonium salicylate | 1 | Diethylene glycol | 30 | 0.20 | — |
| Comparative Example 3 | | Ammonium salicylate | 1 | Ethylene glycol | 30 | 0.27 | — |
| Example 4 | Nb | Ammonium salicylate | 1 | Diethylene glycol | 30 | 0.93 | — |
| Comparative Example 4 | | Ammonium salicylate | 1 | Ethylene glycol | 30 | 1.78 | — |

It is noted from Table 1 that the oxide films formed by using the electrolyte solution containing diethylene glycol as a main solvent according to the invention are small in both Ra and RMS and excellent in surface smoothness as compared with those using a conventional electrolyte solution using ethylene glycol. Also, in comparison between Example 2 and Comparative Example 2, it is noted that Ra and RMS in Example 2 are markedly small as about a half of those in Comparative Example 2 and that in the case where the water content in the electrolyte solution is large, Example 2 is especially large in an improving effect of the surface smoothness. In addition, a difference between Ra and RMS is large in Comparative Example 1 and Comparative Example 2, whereas a difference between Ra and RMS is markedly small in Example 1 and Example 2. Thus, it is noted that the electrolyte solution of the invention is small in influences against the film quality (smoothness) due to a fluctuation of the water content.

Also, it is noted from Examples 3 and 4 and Comparative Examples 3 and 4 that the whole of valve metals including not only Al but also Ta and Nb are useful as the metal of the material to be treated according to the invention.

While the invention has been described in detail and with reference to specific embodiments thereof, it will be apparent to one skilled in the art that various changes and modifications can be made therein without departing from the spirit and scope thereof.

This application is based on a Japanese patent application filed Oct. 12, 2004 (Japanese Patent Application No. 2004-297846) and a Japanese patent application filed Mar. 23, 2005 (Japanese Patent Application No. 2005-084209), the contents of which are incorporated therein and made hereof by reference.

Industrial Applicability

The electrolyte solution and the method of forming an oxide film of the invention can be suitably employed for the formation of almost all oxide films which are required to be minute and smooth in surface, such as thin film transistors, ceramic capacitors, MIM type diodes, and MIM type field emission devices.

The invention claimed is:

1. A method of forming an oxide film, the method comprising anodically oxidizing a material to be treated comprising a metal selected from the group consisting of Al, Ta and Nb as a principal component in an electrolyte solution;

wherein the electrolyte solution comprises

50% by mass or more of diethylene glycol, ammonium salicylate, and 10 to 30% by mass of water.

2. The method of claim 1, wherein the ammonium salicylate is comprised in the electrolyte solution in an amount of 1% by mass, based on the mass of the electrolyte solution.

3. The method of claim 2, wherein the water content is 10% by mass.

4. The method of claim 2, wherein the water content is 30% by mass.

* * * * *